US009695665B2

(12) United States Patent
Older et al.

(10) Patent No.: US 9,695,665 B2
(45) Date of Patent: Jul. 4, 2017

(54) SUBSEA CHEMICAL INJECTION SYSTEM

(71) Applicant: TRENDSETTER ENGINEERING, INC., Houston, TX (US)

(72) Inventors: David Older, Houston, TX (US); Jay Bullard, Houston, TX (US); Brent Cox, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 81 days.

(21) Appl. No.: 14/739,229

(22) Filed: Jun. 15, 2015

(65) Prior Publication Data

US 2016/0362956 A1 Dec. 15, 2016

(51) Int. Cl.
*E21B 33/076* (2006.01)
*E21B 43/013* (2006.01)

(52) U.S. Cl.
CPC ..... *E21B 33/076* (2013.01); *E21B 43/013* (2013.01)

(58) Field of Classification Search
CPC ..... E21B 37/06; E21B 41/02; E21B 33/076; E21B 43/013
See application file for complete search history.

(56) References Cited

U.S. PATENT DOCUMENTS 5,085,277 A 2/1992 Hopper
6,663,361 B2 12/2003 Kohl et al.
7,234,524 B2 6/2007 Shaw et al.
7,721,807 B2 5/2010 Stoisits et al.
8,133,041 B2 3/2012 Ludlow et al.
8,430,169 B2 4/2013 Stoisits et al.
8,555,914 B2 * 10/2013 Smith, IV ..... E21B 37/06 137/10
9,309,750 B2 * 4/2016 Coonrod ..... E21B 33/068
2002/0040783 A1 * 4/2002 Zimmerman ..... B63G 8/001 166/366
2004/0168811 A1 * 9/2004 Shaw ..... E21B 41/02 166/368
2009/0294125 A1 * 12/2009 Donald ..... E21B 33/03 166/270
2013/0327534 A1 * 12/2013 Christie ..... E21B 33/0355 166/345
2014/0318797 A1 10/2014 Vangasse et al.

* cited by examiner

*Primary Examiner* — James G Sayre
(74) *Attorney, Agent, or Firm* — Egbert Law Offices, PLLC

(57) ABSTRACT

A subsea chemical injection system has a subsea structure, a manifold connected by jumper to the subsea structure, a coiled tubing, a disconnect mechanism affixed to the coiled tubing, and a hose extending from the disconnect mechanism to the manifold such that the chemical flowing through the coil tubing can selectively flow through the disconnect mechanism and through the hose to the subsea structure. The disconnect mechanism is adapted to selectively release from the hose. The disconnect mechanism has a connector affixed thereto. A hydraulic fluid supply is connected to the connector so as to selectively release the connector from the hose. Control lines can extend from a surface location to a control module and the disconnect mechanism for selectively delivering for receiving signals from the subsea structure.

17 Claims, 6 Drawing Sheets

SUBSEA CHEMICAL INJECTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for injecting chemicals, such as acid, into a subsea structure, such as a subsea tree. More particularly, the present invention relates to systems for injecting chemicals into a subsea structure in which the chemicals can be delivered by coiled tubing from a surface location. Additionally, the present invention relates to control systems used for the controlling of the operation of the subsea structure.

2. Description of Related Art Including Information Disclosed Under 37 CFR 1.97 and 37 CFR 1.98.

Over the recent past, the search for oil and gas in locations offshore has moved into progressively deeper water. Wells are now commonly drilled at depths of thousands of feet below the surface of the ocean. Additionally, wells are now being drilled in more remote offshore locations. The drilling and maintenance of deep and remote offshore wells is expensive. In an effort to reduce drilling and maintenance expenses, remote offshore wells are oftentimes drilled in clusters. A grouping of wells in a clustered subsea arrangement is sometimes referred to as a "subsea well site". A subsea well site typically includes producing wells completed for production in at least one pay zone. In addition, a well site will often include one or more injection wells to aid in maintaining in-situ pressure for water drive and gas expansion drive reservoirs.

The grouping of subsea wells facilitates the gathering of production fluids into a local production manifold. Fluids from the clustered wells are delivered to the manifold by flowlines called "jumpers". From the manifold, production fluids may be delivered together to a gathering and separating facility for a production line, or "riser". For well sites that are in deeper waters, the gathering facility is typically a floating production storage and offloading vessel.

The clustering of wells also allows for multiple control lines and chemical treatment lines to extend from the ocean surface downwardly to the clustered wells. These lines are commonly bundled into one or more "umbilicals". The umbilical terminates at an "umbilical termination assembly" at the ocean floor. A control line may carry hydraulic fluid used for controlling items of subsea equipment at subsea distribution units, manifolds and trees. Such control lines allow the actuation of safety valves and other subsea components from the surface. In addition, the umbilical may transmit chemical inhibitors to the ocean floor and then to equipment of the subsea processing system.

Often, a variety of chemicals (also referred to as "additives") are introduced into the production wells and processing units to control, among other things, corrosion, scale, paraffin, emulsions, hydrates, hydrogen sulfide, asphaltens, inorganics and formation of other harmful chemicals. In offshore oilfields, a single offshore platform (e.g., a vessel, a semi-submersible, or a fixed system) can be used to supply these additives to several producing wells.

The equipment used to inject additives includes a chemical supply unit, a chemical injection unit, and a capillary or tubing (also referred to as a "conductor line") that runs from the offshore platform through or along the riser and into the subsea well bore. Preferably, the additive injection system supply precise amounts of additives. It is also desirable for the systems to periodically or continuously monitor the actual amount of the additives being dispensed, determine the impact of the dispersed additives, and vary the amount of the additives as needed to maintain certain desired parameters of interest within their respectively desired ranges or at their desired values.

Coiled tubing has been increasingly used in the subsea environment. Coiled tubing can easily be placed upon large reels so that hundreds of feet of tubing can be easily deployed to the offshore location. In the past, coiled tubing has served a variety of purposes in delivering and removing fluids from the subsea environment. However, the coiled tubing has not seen great applicability in delivering and injecting chemicals into the subsea structure, such as a Christmas tree, or for the transmitting of control signals to the subsea tree. One of the problems associated with such coiled tubing is the possibility of damage created when extreme forces are applied to the tubing. Whenever the tubing would be disconnected by force from the subsea structure, damage to the subsea structure could occur and a resulting environmental event could also occur.

In the past, various patents have issued relating to injecting of fluids into subsea structures. For example, U.S. Pat. No. 5,085,277, issued on Feb. 4, 1992 to A. P. Hopper, describes a subsea well injection system in which a slurry of oil-impregnated cuttings from the use of the drilling mud are injected into the annulus of a subsea well and then into the porous formation through which the well has passed. This is accomplished using an apparatus on a guide base surrounding the subsea wellhead. The guide base includes a coupling for a pipe extending from the drilling rig, a one-way isolation valve and pipework leading to the outermost housing of the well. The outermost housing has ports to carry the slurry into the outermost annulus and inner housings also have ports to carry the slurry into the inner annuli. Interior housings also have a one-way check valve to control the injection.

U.S. Pat. No. 6,663,361, issued on Dec. 16, 2003 to Kohl et al., shows a subsea chemical injection pump for injecting chemicals into a subsea system at depths of up to 10,000 feet. This chemical injection pump employs an actuator, such as a solenoid, to power a double-acting actuator rod and plungers thereon. The pump generates low pressures and low fluid volumes.

U.S. Pat. No. 7,234,524, issued on Jun. 26, 2007 to Shaw et al., discloses a subsea chemical injection unit for additive injection and monitoring system for oilfield operations. The system monitors and controls the injection of additives into formations recovered through a subsea well. The system includes a chemical injection unit and a controller positioned at a remote subsea location. The injection unit utilizes a pump to supply one or more selected additives from a subsea or remote supply unit. The controller operates the pump to control the additive flow rates based on signals provided by sensors measuring a parameter of interest. The system includes a surface facility for supporting the chemical injection and monitoring activities.

U.S. Pat. No. 7,721,807, issued on May 25, 2010 to Stoisits et al., provides a method for managing hydrates in a subsea production line. The system has at least one producing well, a jumper for delivering produced fluids from the subsea well to a manifold, a production line for delivering produced fluids to a production gathering facility, and an umbilical for delivering chemicals to the manifold. The subsea well has been shut in so as to leave produced fluids in a substantially uninhibited state. The method generally comprises the steps of pumping a displacement fluid into the chemical injection tubing, pumping the displacement fluid through a chemical injection tubing provided in the umbilical, further pumping the displacement fluid through the manifold and into the production line, and pumping the displacement fluid through the production line so as to displace the produced fluids before hydrate formation may begin.

U.S. Pat. No. 8,133,041, issued a Mar. 13, 2012 to the Ludlow et al., provides a high-pressure pump for use in the injection of liquid chemicals into subsea oil and gas wells and adapted to be positioned in the subsea environment adjacent to the wellhead. The pump includes a piezoelectric actuator for reciprocating a plunger which acts to compress and expand the effect of volume of a pumping chamber. The pumping chamber has a valved inlet connected to a source of liquid and a valved outlet to lead the liquid to the well.

U.S. Pat. No. 8,430,169, issued on Apr. 30, 2013 to Stoists et al., provides a method for managing hydrates in a subsea line. The production system includes a host production facility, a controlled umbilical, at least one subsea production well, and a single production line. The method includes the steps of depressurizing the production line to substantially reduce a solution gas concentration in the produced hydrocarbon fluids, and then re-pressurizing the production line to urge any remaining gas in the free gas phase within the production line back into solution.

U.S. Pat. No. 8,555,914, issued on Oct. 15, 2013 to Smith et al., discloses a method for autonomous control of chemical injection systems for oil and gas wells. A control program for a positive displacement metering system measures the time required for the travel of a free piston in a cylinder of known volume to determine an average flow rate during a full stroke of the piston. The system also measures and records the inlet and outlet pressures between the fluid inlet and the outlet. The control program positions a four-way valve which may function as an adjustable metering orifice in response to the measured average flow rate and/or changes in the inlet and outlet pressures to achieve the desired flow rate. At the end of each stroke, the four-way valve is repositioned to reverse fluid flow through the metering cylinder.

U.S. Patent Publication No. 2014/0318797, published on Oct. 30, 2014 to Vangasse et al., describes a method of applying an acid wash to a subsea connection assembly in order to remove unwanted material such as marine growth and calcareous deposits. The method includes inserting a plug containing channels into a central hole in a stabplate connection. The acid wash is then injected through the plug. The plug may be carried by an operating tool arm of a remotely operated underwater vehicle.

It is an object of the present invention to facilitate the delivery of electrical power and communications to a subsea structure, such as a subsea tree.

It is another object of the present invention to provide a subsea chemical injection system that minimizes the likelihood of environmental impacts.

It is another object the present invention to provide a subsea chemical injection system that minimizes the possibility of damage to subsea hardware.

It is another object of the present invention to provide a subsea chemical injection system that facilitates emergency shutdown.

It is still a further object of the present invention to provide a subsea chemical injection system that can be easily installed and which utilizes coiled tubing.

It is another object of the present invention to provide a subsea chemical injection system which minimizes the potential for the introduction of fatigue loads to the coiled tubing and manifold assembly.

It is still further object of the present invention divided provide a subsea chemical injection system that can increase the vessel operating parameters in comparison with rigid connections.

It is another object of the present invention to provide a subsea chemical injection system which provides a conduit for the purpose of transmitting subsea chemicals and electrical signals.

It is still another object of the present invention to provide a subsea chemical injection system that facilitates the injection of chemicals into the subsea tree from a surface vessel.

These and other objects and advantages of the present invention will become apparent from a reading of the attached specification and appended claims.

BRIEF SUMMARY OF THE INVENTION

The present invention is a subsea chemical injection system that comprises a subsea structure, a manifold connected by jumper to the subsea structure, a coiled tubing, a disconnect mechanism affixed to the coiled tubing, and a hose extending from the disconnect mechanism to the manifold such that the chemical flowing through the coiled tubing can selectively flow through the disconnect mechanism and through the hose to the subsea structure. The disconnect mechanism is adapted to be selectively released from the hose.

The disconnect mechanism has a connector affixed thereto. This connector is connected to the hose. The disconnect mechanism has a hydraulic fluid supply therein. The hydraulic fluid supply is connected to the connector. The hydraulic fluid supply is actuatable so as to release the connector from the hose. The hose has a hub affixed to an end thereof. The connector has a plurality of collet segments engaged with the hub such that the hoses is in fluid communication with an interior of the connector. The connector also has another hub joined with the disconnect mechanism. An actuating piston is positioned over this hub. The actuating piston is movable in one direction so as to release the collet segments from the hub of the hose upon receipt of hydraulic fluid from the hydraulic fluid supply. The hub of the connector has a poppet resiliently mounted therein. The poppet is movable to a position sealing the interior of the connector when the collet segments are released from the hub of the hose. The hub of the hose also has a poppet resiliently mounted therein. The poppet is movable to a position sealing an interior of the hub of the hose when the collet segments are released from the hub of the hose. The disconnect mechanism also has a weak link joined to the hose.

The present invention further includes a first control line extending to the manifold, a control module positioned in the manifold, and a second line extending from the control module to the subsea structure. The first line is connected to the control module such that control signals can be transmitted to the control module. The second line allows the control module to send or receive control signals to or from the subsea tree. The first line extends along the coiled tubing. The second line extends along the jumper. The subsea structure is, in the preferred embodiment, a subsea tree that has a mandrel at a top thereof. The manifold is positioned on the mandrel.

This Section is intended to describe, with particularity, the preferred embodiment of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
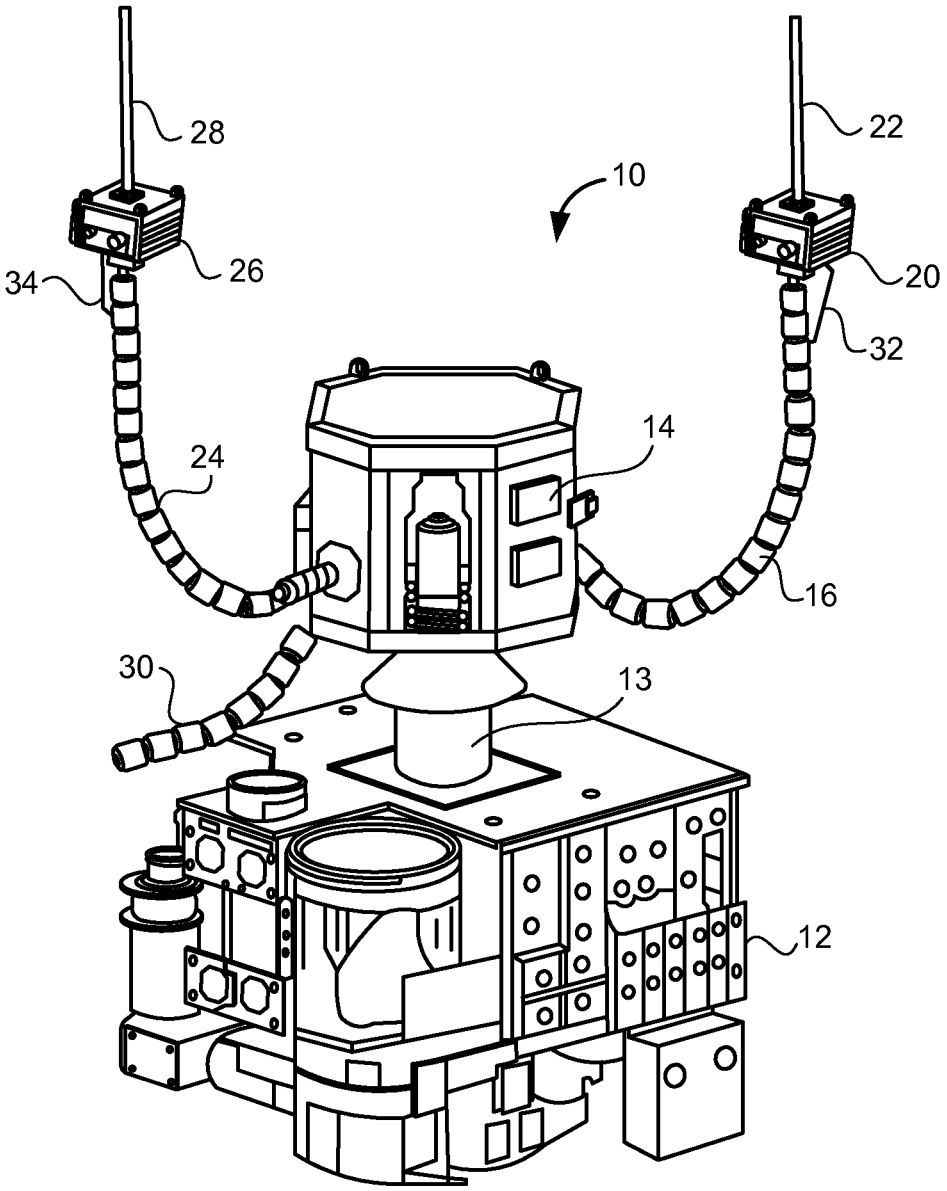
FIG. 1 is a perspective view of the subsea chemical injection system in accordance with the preferred embodiment the present invention.

Referring to FIG. 1, there is shown the subsea chemical injection system 10 in accordance with the preferred embodiment the present invention. The subsea chemical injection system 10 includes a subsea structure 12. The subsea structure 12 can be in the nature of a subsea tree. A manifold 14 is positioned on a mandrel 13 extending upwardly from the subsea structure 12. The manifold 14 is connected by a hose 16 to a first disconnect mechanism 20. A first coiled tubing 22 is connected to the disconnect mechanism 20 and extends upwardly toward a surface location. Another hose 24 is connected to the manifold 14 and extends outwardly therefrom. The second hose 24 is connected to a second disconnect mechanism 26. A second coiled tubing 28 is also connected to the second disconnect mechanism 26 and extends upwardly to a surface location. A jumper 30 is also connected to the manifold 14 and will be connected to the subsea structure 12. Jumper 30 is intended to pass fluids, along with control signals, from the manifold 14 and from the surface location to the subsea structure 12.

In the present invention, the manifold 14 is intended to collect fluids and chemicals as passed therein to the hoses 16 and 24. The manifold 14 will then deliver the fluid to the subsea structure 12 through the jumper 30. Importantly, the first hose 16 can include an electrical line 32 that extends from the first disconnect mechanism 20 along the hose 16 and to the manifold 14. Similarly, another electrical line 34 can also extend from the second disconnect mechanism 26 along the hose 24 to the manifold 14. As will be described hereinafter, the manifold 14 can include a control module therein that is connected to the electrical lines 32 and 34. The control module within the interior of the manifold 14 is intended to provide control signals to the subsea structure 12 and to the disconnect mechanisms 20 and 26. Additionally, the first coiled tubing 22 and the second coiled tubing 28 can also include the electrical lines that are connected to electrical lines 32 and 34, respectively, so that signals from the surface location can be passed to the control module or received from the control module.

The first coiled tubing 22 and the second coiled tubing 28 can be deployed from a vessel at a surface location. The first coiled tubing 22 terminates at the disconnect mechanism 20. The second coiled tubing 28 terminates at the second disconnect mechanism 26. The coiled tubing 22 and 28 will hang in the water column some distance above the subsea structure 12. The flexible hoses 16 and 24 include an electrical flying lead that connects the disconnect mechanisms 20 and 26 to the manifold 14. The manifold 14 ties in at least one coiled tubing and, preferably, two or more coiled tubing systems together so as to direct the fluid to the jumper 30 and to the subsea structure 12. Electrical power and control signals are delivered to the subsea chemical injection system 10, as well as the subsea structure 12, via an electrical line attached to the coiled tubing 22 and 24, through the disconnect mechanisms 20 and 26, and into the manifold 14. The necessary power and control signals required to control the subsea chemical injection system 10 is directed into the control module located in the manifold 14. The power and signals required to control the subsea structure 12 is simply passed directly therethrough.

Hydraulic power is supplied to the subsea chemical injection system 10 via two methods. The primary method utilizes the low-pressure supply found in the production umbilical system. This low-pressure supply can be fed to the manifold 14 from the production umbilical by a hot stab flying lead connected to a junction plate interface unit. This junction plate interface unit is installed between the production flying lead and the subsea structure 12. The second method for providing hydraulic power to the subsea chemical injection system 10 is through the use of accumulators located within the manifold 14. These accumulators provide only limited functionality before the stored pressure will need to be recharged.

Figure 2:
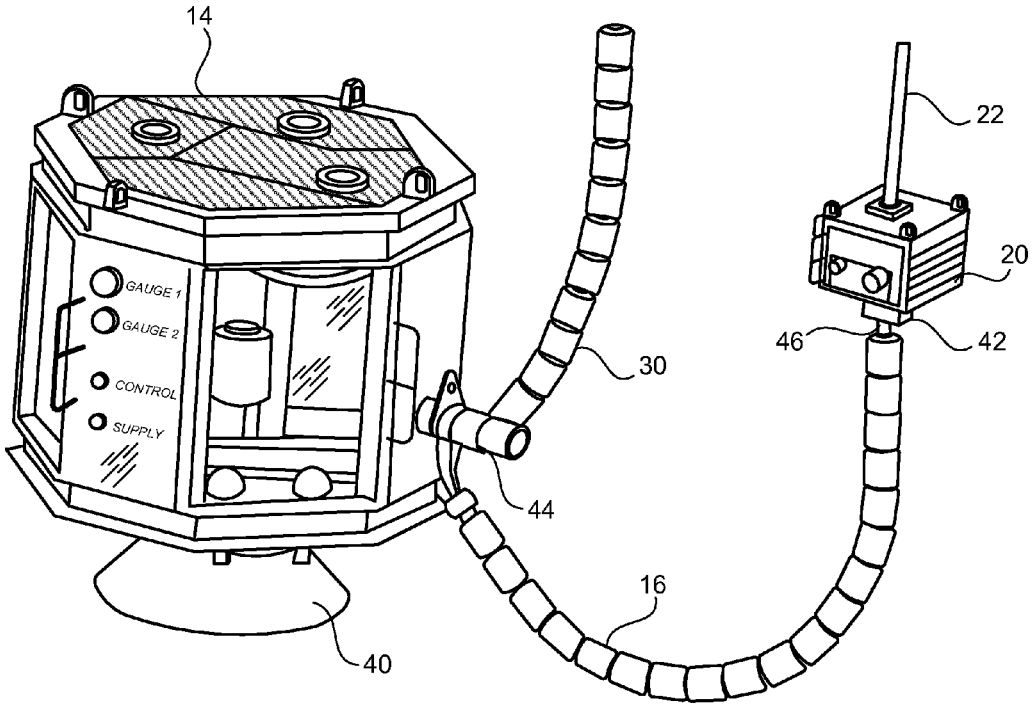
FIG. 2 is an isolated view showing the manifold, the coiled tubing and the disconnect mechanism associated with the subsea chemical injection system of the present invention.

FIG. 2 is a detailed view of the manifold 14, along with the jumper 30, the hose 16, the first disconnect mechanism 20 and the coiled tubing 22. In the embodiment of the subsea chemical injection system 10 shown in FIG. 2, only a single coiled tubing is connected to the manifold 14 for the delivery of chemicals, such as acid, to the manifold 14.

In particular, in FIG. 2, it can be seen that the manifold 14 includes a guide funnel 40 at the bottom thereof. Guide funnel 40 can be utilized so as to properly guide the manifold 14 onto the upper mandrel 13 of the subsea structure 12. Within the concept within the concept of the present invention, the manifold 14 can also be located on other subsea locations, such as a pile, a platform, a slab, or other structures in the vicinity to the subsea structure 12.

The jumper 30 is connected to the manifold 14 such that the chemicals accumulated within the manifold 14 can be delivered to the subsea structure. The hose 16 is also connected to the mandrel 14 so as to pass the chemicals from the coiled tubing 22 into the interior of the manifold 14. Importantly, the disconnect mechanism 20 is connected to the opposite end of the hose 16 from the manifold 14.

During normal operations, the hose 16 serves as a conduit to transmit the subsea chemicals, electrical power, and signals from the disconnect mechanism 20 to the manifold 14. The hose 16 is connected to a connector 42 at the disconnect mechanism 20. The hose 16 is joined to the opposite end of the hose 16 from the disconnect mechanism 20 and is joined to the manifold 14 through the use of a horizontal connector 44. The vertical connector 42 will have a unique structure, as will be described hereinafter. Additionally, a weak link 46 will extend between the hose 16 and the vertical connector 42. The weak link 46 has a configuration such that the weak link 46 will break upon the application of sufficient force prior to any damage occurring to the vertical connector 42, the horizontal connector 44, to the manifold 16 or to the disconnect mechanism 20.

The hose 16 further includes vertebrae bend restrictors at each end thereof so as to prevent damage to the hose in the proximity of the vertical connector 42 and the horizontal connector 44. Additionally, a flotation package can be installed adjacent to the weak link 46. The flotation package supports the free end of the hose 16 when a disconnect sequence is initiated. The hose 16 includes an eight-way electrical flying lead that transmits the necessary power and signals between the disconnect mechanism 20 and the manifold 14.

The disconnect mechanism 20 is connected to the manifold 14 through the hose 16. The hose 16 can be in the nature of a long hose. An electrical flying lead bundle will connect the electronics of the disconnect mechanism 20 to the manifold 14. The flexible connection minimizes the potential for the introduction of fatigue loads into the coiled tubing 22 as well as to the manifold 14. The flexible connection also increases the vessel operating parameters when compared to rigid connections to the manifold and subsea structure. The system further includes a pressure-balanced weak link 46 that can provide passive separation of the hose 16 from the disconnect mechanism 20 as well as isolation of contents from the environment in the unlikely event that the disconnect mechanism cannot or is not activated in a timely manner.

Figure 3:
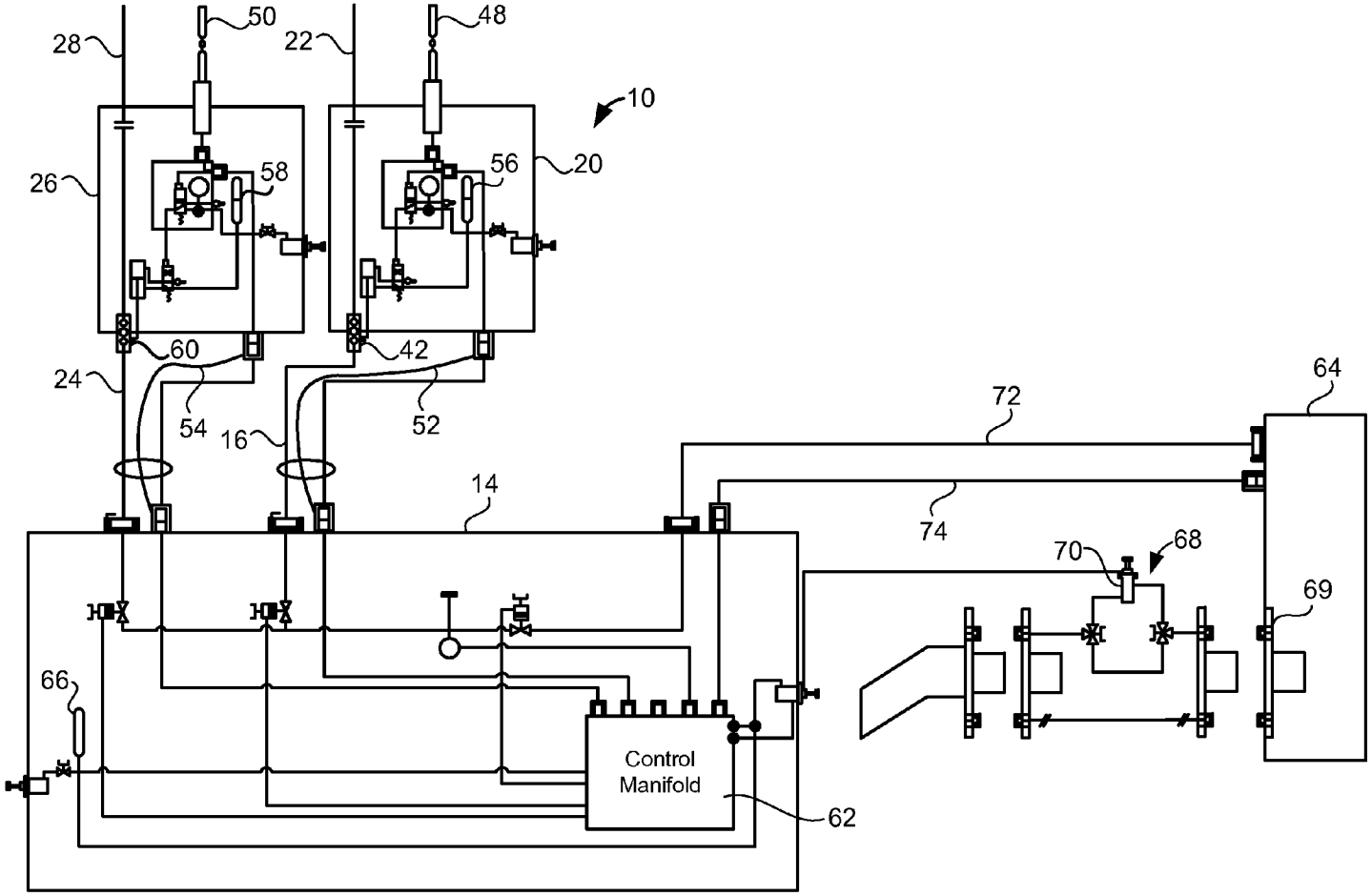
FIG. 3 is a schematic of the subsea chemical injection system of the present invention.

FIG. 3 is a schematic diagram showing the functionality of the subsea chemical injection system 10 of the present invention. The subsea chemical injection system 10 includes the first disconnect mechanism 20 and the second disconnect mechanism 26. The first coiled tubing 22 is illustrated as extending through the first disconnect mechanism 20 so as to be joined to the hose 16 extending from the first disconnect mechanism 20 to the manifold 14. The second disconnect mechanism 26 also is joined to the second coiled tubing 28. Second coiled tubing 28 extends through the second disconnect mechanism 26 and is joined to the hose 24 leading to the manifold 14. An electrical line 48 is illustrated as being connected to the first disconnect mechanism 20. Another electrical line 50 is illustrated as being connected to the second disconnect mechanism 26. The electrical lines 48 and 50 will extend along the respective coiled tubing 22 and 28 such that the electrical lines 48 and 50 can be connected to a surface location. The electrical line 48 will pass through the interior of the first disconnect mechanism 20 so that another line 52 will pass, along with the hose 16, to the manifold 14. Similarly, the line 54 from the second disconnect mechanism 26 will also be connected to the manifold 14. The disconnect mechanisms 20 and 26 include accumulator bottles 56 and 58 in an interior thereof. The accumulators 56 and 58 are adapted so as to provide hydraulic fluid to the respective vertical connectors 42 and 60. The vertical connectors 42 and 60 will have a configuration similar to that shown in FIGS. 5-8 herein.

The manifold 14 includes a control module 62 on an interior thereof. Control module 62 is connected to the electrical lines 52 and 54 therein. The control module 62 is also connected to a variety of other pressure sensors within the interior of the manifold 14. As such, the control module 62 can receive signals from a surface location, can monitor the conditions within the subsea chemical injection system 10, and can send control signals to the subsea tree 64. The manifold 14 further includes another accumulator 66 on an interior thereof so as to provide hydraulic energy for the operation of the junction plate assembly 68 associated with the tree 64.

The junction plate assembly 68 includes a variety of plates that are joined to the tree receptacle 69. In particular, a valve 70 is provided so as to control the flow of hydraulic fluid from the tree 64 or from the accumulator 62 to the tree 64. This will operate in a variety of ways, as will be described hereinafter. It can be seen that the chemicals that have flowed through the coiled tubing 22 and 28 and through the manifold 14 are delivered along line 72 to the tree 64. The electrical signals from the surface location can be delivered through the control module 62 along line 74 for the operation of the tree 64.

Figure 4:
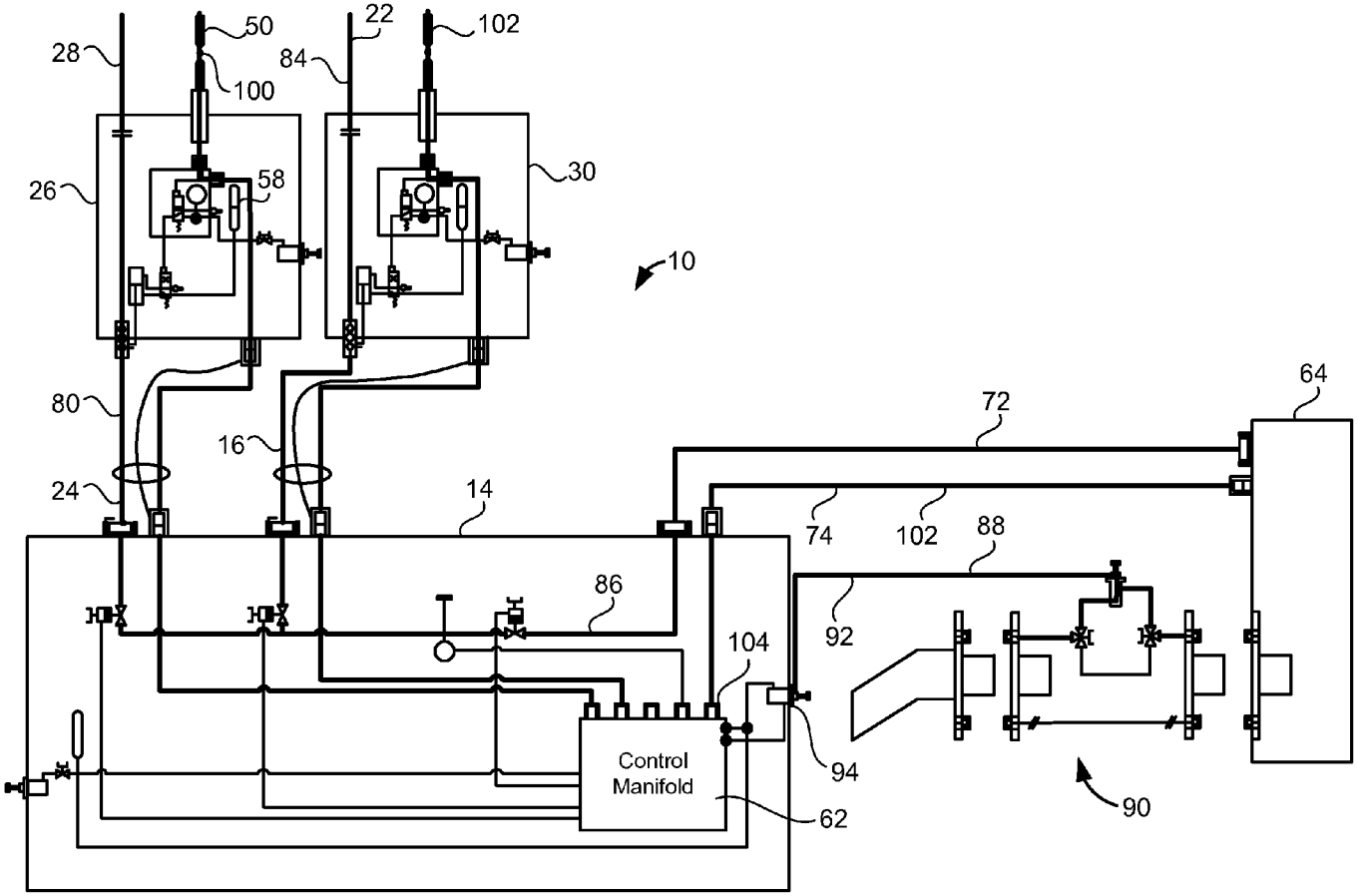
FIG. 4 is a schematic showing the subsea chemical injection system of the present invention and, in particular, showing the flow paths for the fluids and the electricity used in the system.

For clarity, FIG. 4 illustrates the subsea chemical injection system 10 of the present invention with the various flow paths illustrated by heavier lines. For example, the injection flow path 80 serves to inject chemicals to the tree 64. In particular, the chemical injection will flow through the second coiled tubing 28, through the second disconnect mechanism 26, along line 24 through the interior of the manifold 14, and along line 72 to the tree 64. It can be seen that the control module 62 is cooperative with the injection path 80 so as to control the flow of fluids therethrough. There is another injection flow path 84 that passes through the first coiled tubing 22, through the first disconnect mechanism 20, through hose 16 and into the manifold 14. This flow path 84 further joins with a pipe 86 formed in the manifold 14 so that the fluid can be delivered to the tree 64 along conduit 72.

The hydraulic fluid flow path 88 is illustrated as extending between the tree 64 and the manifold 14. Hydraulic fluid flow path will pass along a line 92 that extends from the junction plate 90 to the manifold 14. The control module 62 is connected to a valve 94 that is connected to the hydraulic fluid path 88. A first communications path 100 is illustrated as extending to the control module 62. First communications path 100 extends along the electrical line 50 so as to be connected to the electronics associated with the second disconnect package 26. The first communications path 100 further will extend so as to be joined with the manifold 14 and to the control module 62. As such, the communications path of receiving signals from the control module 62 at the surface location and for delivering control signals from the surface location to the second disconnect mechanism 26 and to the manifold 62 is established by the first communications path 100. The subsea tree communications path 102 is illustrated as extending through the manifold 14 and to the tree 64. The subsea tree communications path 102 will pass through the first disconnect mechanism 20 and is joined to the control module 62 within the manifold 14. Control module 62 has a connection 104 with line 74 so as to allow the direct communication from the surface location to the subsea tree 64 along path 102.

The subsea chemical injection system of the present invention has a robust subsea control system in order to facilitate safe operation. The control module 62 is located within the manifold 14. In addition, each of the disconnect mechanisms 20 and 26 also contains a control unit. The control unit in the disconnect mechanisms 20 and 26 simply activate the vertical connector in order to disconnect the disconnect mechanism from the manifold 14. Hydraulic power to the subsea control system is primarily supplied from the production umbilical via the junction plate interface unit 90. Electrical power and signals are supplied from top side control equipment such as laptop computers and power transformers. The laptops communicate with the control module via the electrical lines that are affixed to the coiled tubing 22 and 28.

The control module 62 and the manifold 14 includes a pressure-balanced oil-filled housing that includes the electrical boards, solenoids, and directional control valves. The control module 16 is non-retrievable independently from the manifold. The control module is configured so as to operate the gate valves in the manifold, monitor injection manifold piping pressure, monitor stored accumulator pressure in the disconnect mechanism, activate commanded emergency "disconnect" sequences, bleed low-pressure hydraulics to the subsea tree 64 without bleeding umbilical hydraulic pressure, and pass-through power and signals in order to facilitate control of the subsea tree.

The junction plate assembly 90 is used to supply the injection manifold and its control system hydraulic pressure from the production umbilical. This interface unit is installed so as to be connected to the subsea tree. This junction plate interface unit simply acts as a bridging plate that allows the low-pressure hydraulics to be rerouted to the injection manifold 14 via a hot stab/flying lead. The low-pressure supply will enter the junction plate assembly 90 and is directed to the manifold 14 by operating small ROV-controlled three-way valves. The outlet to the injection manifold 14 can be bypassed by simply operating the three-way valves back to the normal position. A dummy hotstab would also be inserted into the receptacle so as to create a double barrier isolation. All other lines (i.e. high-pressure lines, chemical lines, etc.) can be connected directly coupler-to-coupler without any bypass loop.

The system of the present invention can operate under five different operational modes: (1) normal operation; (2) system shutdown; (3) system shutdown with active disconnect; (4) passive disconnect; and (5) loss of communications.

Under normal upper conditions, the subsea chemical injection system 10 monitors and reports the piping pressure of the manifold 14, the disconnect mechanism and the disconnect mechanisms 20 and 26. Independent operation is allowed to operate the gate valves as required to isolate one coiled tubing riser from the other, circulate through the coiled tubing risers, or isolate the subsea tree. As previously described, hydraulic pressure operates the branch outlet valves and can be supplied by either of the accumulators 56, 58 and 66 or from the production umbilical via the junction plate assembly 90.

System shutdown condition occurs whenever a controlled shutdown of the subsea chemical injection system 10 and the subsea tree 64 is required. A shutdown command is generated from the control system at a surface location and sent to the control module 62 of the manifold 14. The control module then closes the gate valves within the manifold 14 and bleeds the hydraulics to the subsea tree. Another simple command from a laptop computer can be utilized so as to open up the system in order to allow normal operation to occur.

The condition of system shutdown with active disconnect involves a controlled shutdown of the subsea chemical injection system and the subsea tree 64 as well as an active disconnect of the disconnect mechanisms 20 and 26. The shutdown command is generated from a laptop computer at a surface location and delivered to the control module 62 of the manifold 14. The control module then closes the gate valves within the manifold 14, bleeds the hydraulics to the subsea tree, and sends an electronic signal to the disconnect mechanisms 20 and 26 to carry out the active disconnect sequence. Once the vertical connector is actuated, as will be described hereinafter, the internal poppets will engage with and seal the bore so as to prevent fluid flow to the environment. The upper part of the hose will include a flotation block that maintains the ejected hub elevation above the mudline and adjacent subsea equipment. After an active disconnect, the coiled tubing risers and the disconnect mechanisms can be recovered to the surface. Additionally, the hoses 16 and 24 can also be recovered to the surface for inspection and reinstallation on to the disconnect mechanisms.

Under the passive disconnect condition, the disconnect mechanisms 20 and 22 can be operated to separate the disconnect package from the hose in order to mitigate environmental issues. This scenario is envisioned if the active disconnect is not activated in a timely manner or fails to release the hose from the disconnect mechanism. The passive disconnect method simply relies on the hose and disconnect package experiencing a determined amount of tension before the weak link separates below the vertical connector. A steel tension wire is connected to the vertical connector and then pulls out the electrical flying lead from the disconnect mechanism so as to allow the disconnect bracket mechanism to be fully disconnected from the hose and the manifold 14. As with the active disconnect operation, the coiled tubing risers, disconnect mechanisms and the hose bundles can be recovered at the surface for inspection and reinstallation.

In the event of a loss of communications, the control module 62 of the manifold 14 will deenergize the control valve so as to allow hydraulic pressure to the gate valves and the subsea tree to vent to the seawater. As a result, all valves will be closed so as to bring the system to a fail-safe condition.

The subsea chemical injection system 10 of the present invention is designed to facilitate a local shutdown of the subsea tree 62 by bleeding the low-pressure supply to the tree. However, this action must be isolated to the subsea tree 64 so as to lead the production umbilical to service the other subsea tree. The control module 62 and the manifold 14 gives the operator proper control by directing the low-pressure fluid supply from the tree 64 to the manifold 14 and back to the tree 64. This bypass is accomplished by installing the junction plate assembly 90 in the manner described hereinabove. When required to bleed the low-pressure supply, the control module 62 will quickly shift the valve so as to allow only the supply to the subsea tree 64 to vent. The umbilical supply will be blocked so as to prevent a loss of pressure in the umbilical.

Figure 5:
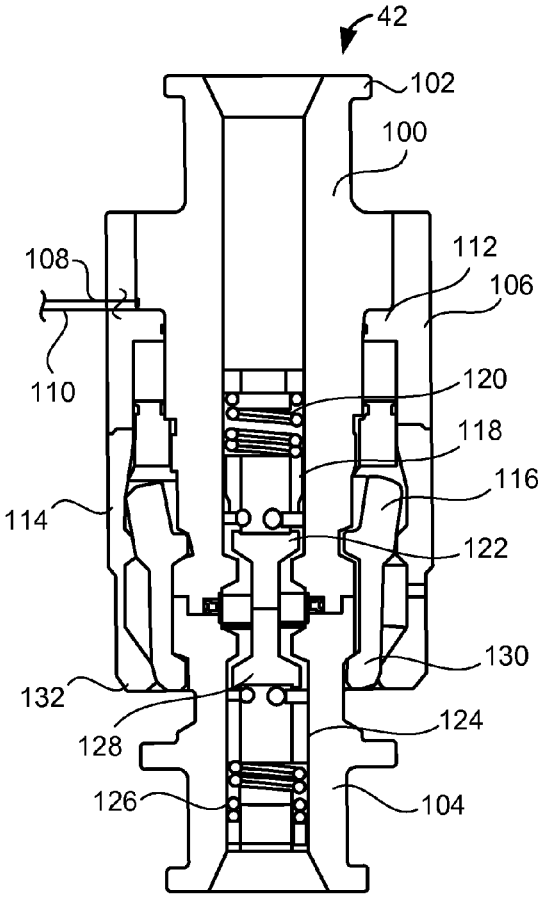
FIG. 5 is a cross-sectional view of the connector as used in the subsea chemical injection system of the present invention in a connected configuration.

Referring to FIG. 5, there is shown the vertical connector 42 that is used to connect the hose 16 to the disconnect package 20. In particular, the vertical connector 42 is illustrated as having a connector body 100 that has a hub 102 suitable for connection to the coiled tubing 22 or to the disconnect mechanism 20. The connector 42 is used so as to connect with an outboard hub 104 that is suitable for connecting with the hose 16 and/or the weak link 46. The connector body 100 has an outer sleeve 106 that is slidably and controllably positioned over the exterior of the connector body 100. A channel 108 formed through the wall of the outer sleeve 106 and includes a conduit 110 that is connected to a source of hydraulic fluid. As such, in order to allow the sliding action of the actuating piston 112, hydraulic fluid can be introduced through the conduit 110 so as to cause the outer sleeve 106 to move from the position shown in FIG. 5 to the positions shown in FIG. 6-8.

A lock ring 114 is in abutment with the end of the outer sleeve 106. When the outer sleeve 106 moves in relation to the connector body 100, the lock ring 114 will also move. There are a plurality of collet members 116 positioned within the interior of the lock ring 114. Each of the collet members 116 has an outer surface with a particular shape which can cause the actions of locking and releasing created by the vertical connector 42 in accordance with the present invention. Additionally, the lock ring 114 also has an interior shape which bears against the outer surface of the collet members 116 so as to facilitate the movement of the collet members 116 between the locking position and the release position.

Importantly, in FIG. 5, it can be seen that there is an interior bore 118 formed inside the connector body 100. A spring 120 is resiliently mounted in the interior bore 118 of the connector body 100. A poppet 122 is located within the interior bore 118 of the connector body 100 and has a surface which can bear against an inner wall of the connector body. Similarly, the outboard hub 104 has an interior passageway 124 that has a spring 126 mounted therein. Spring 126 is configured so as to bear against the poppet 128. Poppet 128 has a surface that is designed to seal in relation to the shoulder formed on the wall of the interior passageway 124 of the outboard hub 104.

FIG. 5 shows the vertical connector 42 in the locked position. As can be seen, the end 130 of the collet members 116 have an interior shoulder that bears against an exterior shoulder at the end of the outboard hub 104. This locking configuration is accomplished by the bearing end 132 of the lock ring 104 strongly urging against the exterior of the end portion 130 of the collet members 116. In this locking configuration, there is no hydraulic fluid introduced into the interior of the outer sleeve 106. As such, the actuating piston 112 will be in its uppermost position and bearing against a shoulder formed on the connector body 100. Also, in this configuration, the end of the poppet 122 is illustrated as bearing against the end of the poppet 128. This will resiliently urge the shoulders of the poppets 122 and 128 away from their seated position. As a result, fluid is able to flow through the interior bore 118 of the connector body 100 and through the interior passageway 124 of the outboard hub 104.

Figure 6:
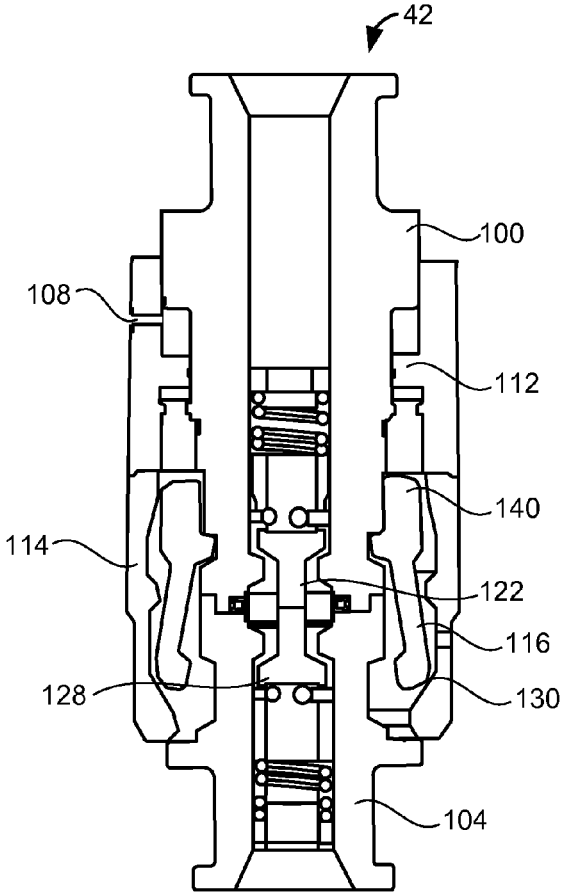
FIG. 6 is a cross-sectional view showing the connector as used in the subsea chemical injection system of the present invention in a release position.

FIG. 6 illustrates the vertical connector 42 in an unlocked position. As can be seen, hydraulic fluid has been introduced through the channel 108 so as to cause the actuating piston 112 to move away from the shoulder of the connector body 100. This movement of the actuating piston 112 will cause the lock ring 114 to also move downwardly. As a result, the inner surface of the lock ring 114 will bear against the back portion 140 of the collet members 116 such that the end portion 130 of the collet members 116 releases from the shoulder at the end of the outboard hub 104. As a result, the collet members 116 will no longer grasp the outboard hub 104. However, at this stage, the poppet 122 still bears against the end of the poppet 128. The ends of the connector body 100 and the outboard hub 104 still bear against each other.

Figure 7:
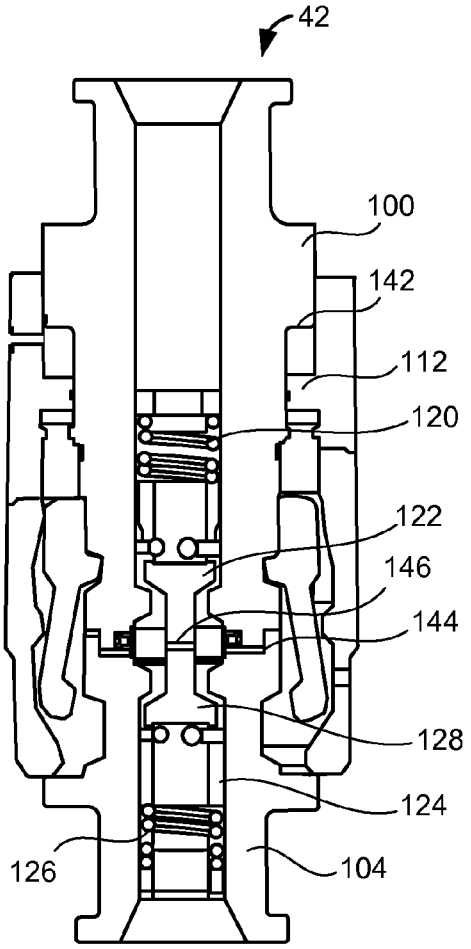
FIG. 7 is a cross-sectional view of the connector used in the subsea chemical injection system of the present invention in a disconnected position.

In FIG. 7, it can be seen that the actuating piston 112 has moved further away from the shoulder 142 of the connector body 100. This causes the collet members 116 to further urge the outboard hub 104 away from the end of the connector body 100. As such, it can be seen that a separation space 144 occurs between the ends of the connector body 100 and the outboard hub 104. This is the release position. As can also be seen there is a small space 146 between the ends of the poppets 122 and 128. Since there is a space 146, the spring 120 will urge the poppet 122 into strong abutment with the inner wall of the interior base 118 of the connector body 100. As a result, the interior of the connector body 100 is sealed by the poppet 122. Similarly, the spring 126 will urge the poppet 128 against the shoulder on the inner wall of the interior passageway 124 of the outboard hub 104. As a result, the interiors of the connector body 100 and the outboard hub 104 are sealed. When the connector 100 of the vertical connector 42 is released from the outboard hub 104 of the hose 16, the poppets 122 and 128 prevent spillage or leakage of fluid into the subsea environment.

Figure 8:
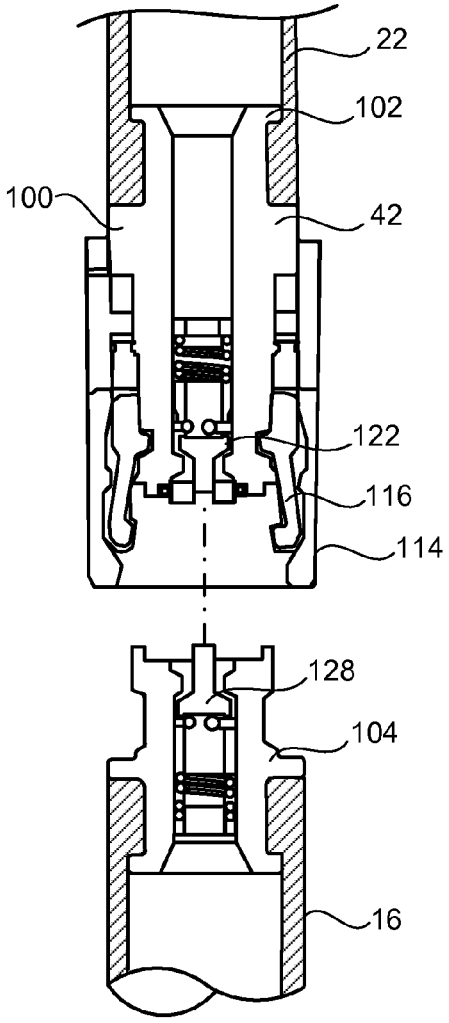
FIG. 8 is a cross-sectional view of the connector of the subsea chemical injection system of the present invention in which the hose to the manifold has been separated from the connector.

FIG. 8 shows how the hose 16 and the outboard hub 104 have been released from the vertical connector 42 associated with the coiled tubing 22. In particular, coiled tubing 22 is shown as joined to the inboard hub 102 of the connector body 100. The collet members 116 are in the fully released position, as shown in FIG. 7. As a result, the weight associated with the outboard hub 106 and the hose 16 will cause the outboard hub 104 to separate, by action of gravity, from the interior of the lock ring 114. In this configuration, the poppet 122 will be in a sealed relationship with the fluid passageway of the connector body 100 so as to prevent any liquid within the vertical connector 42 from releasing into the marine environment. Similarly, it can be seen that the poppet 128 is in sealed relationship with the inner wall of they interior passageway of the outboard hub 104. Once again, this serves to prevent any release of contaminants from the interior of the hose 16 into the marine environment.

In order to install the outboard hub 104 of the hose 16 into the vertical connector 42, it is only necessary to reverse the steps illustrated in FIGS. 5-7 herein. In this manner, the vertical connector 42 it can easily engage with the outboard hub 104 of the hose 16 in order to create the requisite sealed fluid tight relationship therebetween.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A subsea chemical injection system comprising:

a subsea structure;

a manifold connected by a jumper to said subsea structure;

a coil tubing;

a disconnect mechanism affixed to said coil tubing; and a hose extending from said disconnect mechanism to said manifold such that a chemical flowing through said coil tubing can selectively flow through said disconnect mechanism and through said hose to said subsea structure, said disconnect mechanism adapted to selectively release from said hose, said disconnect mechanism having a connector affixed thereto, said connector connected to said hose, said disconnect mechanism having a hydraulic fluid supply therein, said hydraulic fluid supply connected to said connector, said hydraulic fluid supply actuatable as to release said connector from said hose.

2. The subsea chemical injection system of claim 1, said hose having a hub affixed to an end thereof, said connector having a plurality of collet segments engaged with said hub such that said hose is in fluid communication with an interior of said connector.

3. The subsea chemical injection system of claim 2, said connector further comprising:

another hub joined with said disconnect mechanism; and an actuating piston positioned over said another hub, said actuating piston movable in one direction so as to release said collet segments from said another hub of said hose upon receipt of hydraulic fluid from said hydraulic fluid supply.

4. The subsea chemical injection system of claim 3, said another hub of said connector having a poppet resiliently mounted therein, said poppet movable to a position sealing said interior of said connector when said collet segments are released from said hub of said hose.

5. The subsea chemical injection system of claim 3, said hub of said hose having a poppet resiliently mounted therein, said poppet movable to a position sealing an interior of said hub of said hose when said collet segments are released from said hub of said hose.

6. A subsea chemical injection system comprising:

a subsea structure;

a manifold connected by a jumper to said subsea structure;

a coil tubing;

a disconnect mechanism affixed to said coil tubing; and a hose extending from said disconnect mechanism to said manifold such that a chemical flowing through said coil tubing can selectively flow through said disconnect mechanism and through said hose to said subsea structure, said disconnect mechanism adapted to selectively release from said hose, said disconnect mechanism having a weak link joined to said hose.

7. A subsea chemical injection system comprising:

a subsea structure;

a manifold connected by a jumper to said subsea structure;

a coil tubing;

a disconnect mechanism affixed to said coil tubing;

a hose extending from said disconnect mechanism to said manifold such that a chemical flowing through said coil tubing can selectively flow through said disconnect mechanism and through said hose to said subsea structure, said disconnect mechanism adapted to selectively release from said hose;

a first line extending to said manifold;

a control module positioned in said manifold, said first line connected to said control module such that control signals can be transmitted to said control module; and a second line extending from said control module to said subsea structure such that said control module can send control signals to said subsea structure.

8. The subsea chemical injection system of claim 7, said first line extending along said coil tubing, said second line extending along said jumper.

9. A subsea chemical injection system comprising:

a subsea structure;

a manifold connected by a jumper to said subsea structure;

a coil tubing;

a disconnect mechanism affixed to said coil tubing; and a hose extending from said disconnect mechanism to said manifold such that a chemical flowing through said coil tubing can selectively flow through said disconnect mechanism and through said hose to said subsea structure, said disconnect mechanism adapted to selectively release from said hose, said subsea structure having a mandrel at a top thereof, said manifold positioned on said mandrel.

10. A system for injecting a chemical into a subsea structure, the system comprising:

a manifold having a jumper extending therefrom, said jumper adapted to be connected to the subsea structure;

a hose connected to said manifold and extending therefrom, said hose being in fluid communication with said manifold;

a disconnect mechanism connected to an end of said hose opposite said manifold, said disconnect mechanism selectively releasable from said hose;

at least one coiled tubing connected to said manifold so as to deliver the chemical into said manifold from a surface location;

a control module positioned in said manifold;

a first line connected to said control module extending from the surface location, said first line for transmitting control signals to or from said control module; and a second line connected to said control module and adapted to be connected to the subsea structure such that control signals can be transmitted from the control module to the subsea structure or transmitted from the subsea structure to the control module.

11. The system of claim 10, said first line extending along said coil tubing, said second line extending along said hose.

12. The system of claim 10, said disconnect mechanism having a connector affixed thereto, said hose releasably affixed to said connector.

13. A system for injecting a chemical into a subsea structure, the system comprising:

a manifold having a jumper extending therefrom, said jumper adapted to be connected to the subsea structure;

a hose connected to said manifold and extending therefrom, said hose being in fluid communication with said manifold;

a disconnect mechanism connected to an end of said hose opposite said manifold, said disconnect mechanism selectively releasable from said hose; and at least one coiled tubing connected to said manifold so as to deliver the chemical into said manifold from a surface location, said disconnect mechanism having a hydraulic fluid supply therein, said hydraulic fluid supply connected to said connector, said hydraulic fluid supply actuatable so as to release said connector from said hose.

14. The system of claim 13, said hose having a hub affixed to an end thereof, said connector having a plurality of collet segments engaged with said hub such that said hose is in fluid communication with an interior of said connector.

15. The system of claim 14, said connector further comprising:

another hub joined with said disconnect mechanism; and an actuating piston positioned over said another hub, said actuating piston movable in one direction so as to release said collet segments from said hub of said hose upon receipt of hydraulic fluid from said hydraulic fluid supply.

16. The system of claim 15, said another hub of said connector having a poppet resiliently mounted therein, said poppet movable to a position sealing said interior of said connector when said collet segments are released from said hub of said hose, said hub of said hose having another poppet resiliently mounted therein, said another poppet movable to a position sealing an interior of said another hub when said collet segments are released from said another hub of said hose.

17. A system for injecting a chemical into a subsea structure, the system comprising:

a manifold having a jumper extending therefrom, said jumper adapted to be connected to the subsea structure;

a hose connected to said manifold and extending therefrom, said hose being in fluid communication with said manifold;

a disconnect mechanism connected to an end of said hose opposite said manifold, said disconnect mechanism selectively releasable from said hose; and at least one coiled tubing connected to said manifold so as to deliver the chemical into said manifold from a surface location, said disconnect mechanism having a weak link joined to said hose.

* * * * *